US005964382A

United States Patent [19]

Randal

[11] Patent Number: 5,964,382

[45] Date of Patent: Oct. 12, 1999

[54] DEVICE FOR ACCELERATING CONSUMPTION OF LIQUID FROM BOTTLES

[76] Inventor: Michael Randal, 5352 Carfax Ave., Lakewood, Calif. 90713

[21] Appl. No.: 08/967,483

[22] Filed: Nov. 11, 1997

[51] Int. Cl.[6] ..... B67D 3/00; A47G 21/18

[52] U.S. Cl. ..... 222/481.5; 222/478; 239/333

[58] Field of Search ..... 222/478, 479, 222/480, 481, 481.5, 464.2; 239/33

[56] References Cited

U.S. PATENT DOCUMENTS

| | | | |
|---|---|---|---|
| 2,657,951 | 11/1953 | North, Jr. | 222/478 |
| 2,783,923 | 3/1957 | Croce | 222/478 |
| 2,825,495 | 3/1958 | Fazio | 222/478 |
| 4,793,514 | 12/1988 | Sheets | 222/67 |
| 5,326,003 | 7/1994 | Kitto et al. | 222/460 |
| 5,449,098 | 9/1995 | Offman | 222/481.5 |
| 5,560,522 | 10/1996 | Clark | 222/481.5 |
| 5,601,217 | 2/1997 | Wagner | 222/481.5 |

FOREIGN PATENT DOCUMENTS

| | | |
|---|---|---|
| 247267 | of 1926 | United Kingdom . |
| 257426 | of 1926 | United Kingdom . |

*Primary Examiner*—Kevin P. Shaver
*Assistant Examiner*—Keats Quinalty
*Attorney, Agent, or Firm*—Price,Gess & Ubell

[57] ABSTRACT

A flexible cylindrical body tube adapted to sealingly engage a beer bottle at one end and mounting a side-venting hose of a length selected to extend into the beer bottle and down into the bottle to a position adjacent the bottom of the bottle. When so placed, the bottle and hose may be inverted with a finger placed over the vent hose, the open end of the body tube brought to the mouth, the bottle and tube inverted and the finger removed, resulting in rapid continuous discharge of the fluid from the bottle into the mouth of the user.

22 Claims, 1 Drawing Sheet

DEVICE FOR ACCELERATING CONSUMPTION OF LIQUID FROM BOTTLES

BACKGROUND OF THE INVENTION

1. Field of the Invention

The subject invention relates generally to a device for accelerating the consumption of liquids from a container and, more particularly, to such a device for expediting the discharge of fluids from bottles.

2. Description of Related Art

The subject invention finds particular application in the activity commonly referred to as "beer chugging." This activity has been popularized by such songs as Roger Miller's "Chug-a-Lug," takes many forms, and occurs in many places, including college campuses, spring break parties and other occasions of unrestrained revelry. One familiar example of this activity is the "chug contest" in which the goal is to ingest a mug of beer as quickly as possible, typically timed by a stopwatch.

The attraction of this relatively uninhibited and "macho" activity has prompted efforts to "chug" beer and other alcoholic beverages from other containers such as cans and bottles. In the case of cans, a chugging method is known in the prior art wherein a hole is punched or otherwise created in the bottom of a beer can to increase the rate of flow of beer from the can. In application, the hole is covered by a finger or thumb and the can inverted with the opening over the user's mouth. The finger is then removed, causing the liquid contents of the can to rapidly discharge down the user's throat in the conventional chugging style.

With respect to beer bottles, however, a problem has existed in that holes cannot be readily punched in the bottom of a conventional beer bottle. Thus, it has been heretofore impossible to achieve a rapid chugging action with a conventional beer bottle. Instead, the fluid tends to exit the bottle in intermittent bursts which requires several swallowing actions by the drinker rather than a smooth flow of the entire contents down the throat.

OBJECTS AND SUMMARY OF THE INVENTION

It is therefore an object of the invention to provide a device for accelerating the flow of liquid from a container thereof;

It is another object of the invention to provide such a device particularly adapted to enhance chugging of beer from bottles thereof; and It is another object of the invention to provide such a device which is compact, easily manufactured and easily used.

These and other objects are achieved, according to the invention, by the provision of a flexible cylindrical body tube adapted to sealingly engage a beer bottle at one end and mounting a side-venting hose of a length selected to extend into the beer bottle and down to a position adjacent the bottom of the bottle. When so placed, the bottle and hose may be inverted, while a finger is placed over the opening of the vent hose. The exposed vent hose opening is covered with a finger and the open end of the body tube is brought to the mouth. The bottle and tube are then tilted upside down and the finger removed, resulting in rapid continuous discharge of the fluid from the bottle into the mouth of the user.

BRIEF DESCRIPTION OF THE DRAWINGS

The preferred embodiment and best mode for practicing the subject invention will now be described in conjunction with the drawings of which.

DETAILED DESCRIPTION OF THE PREFERRED EMBODIMENTS

Figure 1:
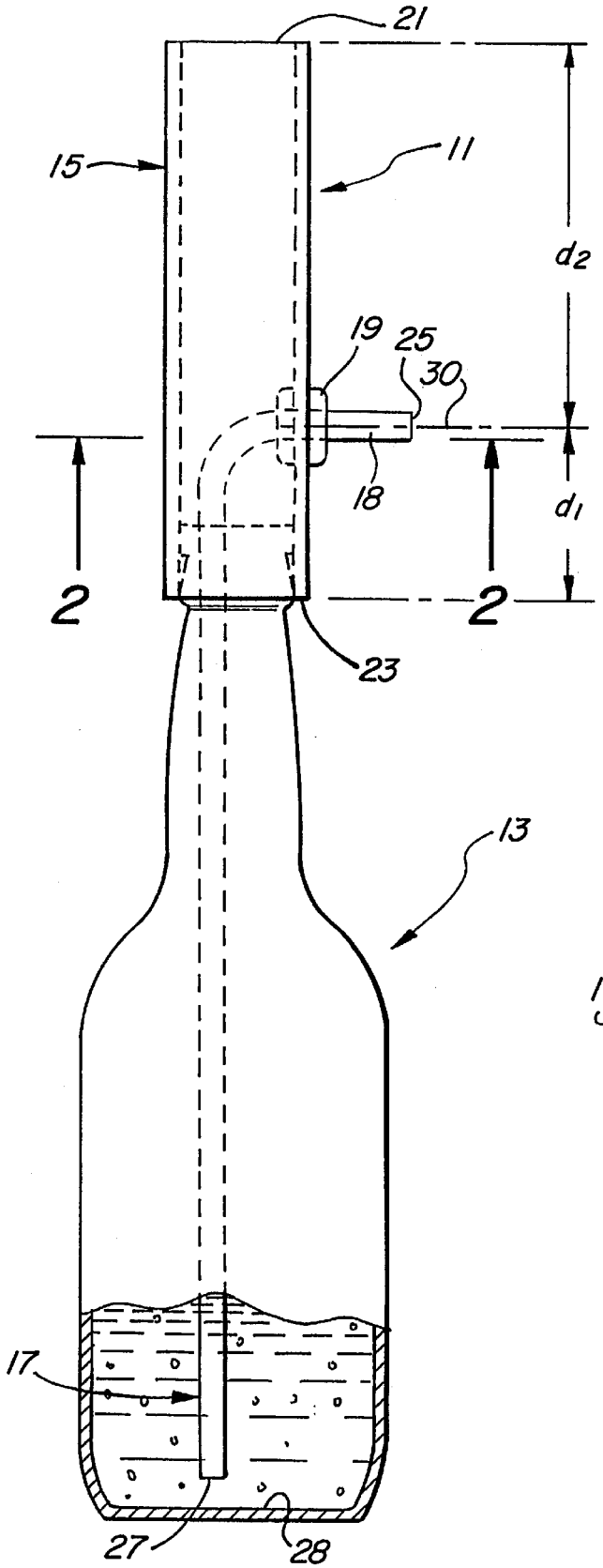
FIG. 1 is a front view of the preferred embodiment installed on a bottle.
Figure 2:
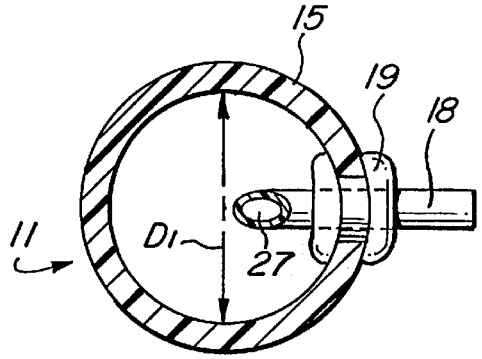
FIG. 2 is a cross-sectional view of the preferred embodiment taken at 2—2 of FIG. 1.

As illustrated in FIGS. 1 and 2, the fluid flow accelerating device 11 of the preferred embodiment includes a flexible cylindrical body tube or hose 15, a vent hose or tube 17, and a rubber grommet or other sealing member 19.

As shown, the vent hose 17 passes through a hole drilled or otherwise formed on a horizontal centerline 30 in the side of the body tube 15. The inside diameter $D_1$ of the body tube 15 may be one inch and its outside diameter 1¼". The body tube 15 is preferably fabricated of FDA approved flexible polyvinyl chloride (PVC) having a shore of 85. This particular material retains its flexibility over the desired operating temperature range. Various other materials such as a urethane could be used to fabricate the body tube 15.

The vent hose 17 is preferably a cylindrical hollow plastic tube having an interior channel of circular cross section. The vent hose 17 includes an exterior side pipe portion 18, which provides the user activation point of the device 11. The preferred vent hose 17 is ten inches in length, has an inside diameter of 3/16", an outside diameter of 5/16 and a wall thickness of 1/16. The inventor has found that an inside diameter larger than 3/16 results in a fluid discharge from the bottle 13 which is too rapid for most users.

The vent hose 17 is preferably fabricated of FDA approved flexible PVC having a shore of 72. The particular material is selected so that the vent hose 17 can accomplish the necessary bending without kinking. Other suitable materials such as urethane again could be used.

The grommet 19 provides a seal between the vent hose 17 and body tube 15 such that the liquid contents of the bottle 13 will not leak through the side of the body tube 15. The vent hose 17 is further selected of a length such that the interior portion 27 thereof extends out through the attachment end 23 of the body tube 15 and into the bottle 13 preferably stopping just short of the interior bottom surface 28 of the bottle 13. The hose 17 can also operate curled up on the bottom 28.

In fabrication, the rubber grommet 19 is manually or otherwise installed and the vent hose 17 is thereafter simply pushed through the grommet and pulled out the attachment end 23 of the body tube 15. The length of the hose 17 is selected for purposes of venting the space which forms between the bottom surface 28 of the bottle 13 and the liquid contents when the bottle 13 is inverted.

As further illustrated in FIG. 1, the vent hose 17 exits the side of the body tube 15 at a point located near the attachment end 23 of the body tube 15. In one embodiment, for example, the distance $d_1$ from the centerline 30 of the side hole to the attachment end 23 may be one and a half inches (±0.25 inch), while distance $d_2$ from the centerline 30 to the imbibing end 21 of the body tube 15 is 3½ inches. Dimension $d_1$ is the most important because at less than 1½ inches, the device 11 may not achieve a suitable seal with various bottlenecks.

In operation, the small vent hose 17 is placed into the bottle 13 while the body tube 17 is slid over the top of the bottle 13 and securely installed. Next, the exposed open end 25 of the side pipe 18 is covered with a finger or thumb and the imbibing end 21 is brought up to and placed in the mouth of the user. The bottle 13 is then tilted upside down and the finger thereafter removed from the open end 25 of the vent hose 17, whereupon the fluid in bottle 13 is rapidly discharged from the imbibing end 21 of the body tube 15. During operation, the air flow through the vent hose 17 can be used to operate a whistle if desired.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A fluid flow enhancing device for use with a container having a neck comprising:

a body tube formed entirely of flexible material, and having a passageway of uniform cross-section from an attachment end to an imbibing end thereof, said cross-section being selected such that said attachment end sealingly engages the neck of the container while at the same time said imbibing end fits within the mouth of a user so as to conduct flow of the contents of the bottle from the attachment end to the imbibing end, said body tube having an opening in a side surface thereof; and a vent hose passing through said opening and having a side pipe portion extending outside said body tube and an interior portion of a length selected to extend through said side surface of said body tube into said container for venting the bottom of said container upon inversion of said container to thereby accelerate the discharge of fluid out of said container through said body tube and into the mouth of a user.

2. The device of claim 1 further including a seal located between the side surface of said body tube and said vent hose.

3. The apparatus of claim 2 wherein said seal comprises a rubber grommet.

4. The device of claim 1 wherein said body tube comprises a hollow flexible cylindrical tube.

5. The device of claim 4 wherein said vent hose comprises a flexible plastic tube.

6. The device of claim 5 wherein said opening has a center line located at least 1½ inches above said attachment end.

7. The device of claim 5 wherein said cylindrical tube comprises a polyvinyl chloride material of shore 85.

8. The device of claim 7 wherein said plastic tube comprises a polyvinyl chloride material of shore 72.

9. The device of claim 1 wherein said opening has a center line located at least 1½ inches above said attachment end.

10. The device of claim 1 wherein the inside diameter of said plastic tube is 3/16 inch or less.

11. The device of claim 10 wherein the inside diameter of said cylindrical tube is one inch.

12. The apparatus comprising:

a container having a neck;

a flexible body tube having a passageway of uniform cross-section from an attachment end to an imbibing end thereof, said cross-section being selected such that said attachment end sealingly engages the neck of the container while at the same time said imbibing end fits within the mouth of a user so as to conduct flow of the contents of the bottle from the attachment end to the imbibing end; said body tube having an opening in a side surface thereof; and a vent hose passing through said opening in said side surface and having a side pipe portion extending outside said body tube and an interior portion of a length selected to extend through said body tube into said container for venting the bottom of said container upon inversion of said container to thereby accelerate the discharge of fluid out of said container through said body tube and into the mouth of the user.

13. The apparatus of claim 12 further including a seal located between the side surface of said body tube and said vent hose.

14. The apparatus of claim 13 wherein said seal comprises a rubber grommet.

15. The apparatus of claim 12 wherein said body tube comprises a hollow flexible cylindrical tube.

16. The apparatus of claim 15 wherein said vent hose comprises a flexible plastic tube.

17. The apparatus of claim 12 wherein said opening has a center line located at least 1½ inches above said attachment end.

18. A fluid flow enhancing device for accelerating fluid flow from the neck of a bottle into the mouth of a user, said device comprising:

a hollow flexible cylindrical body tube having a passageway of uniform cross-section from an attachment end to an imbibing end thereof, said cross-section being selected such that said attachment end sealingly engages the neck of the container while at the same time said imbibing end fits within the mouth of a user so as to conduct flow of the contents of the bottle from the attachment end to the imbibing end; said body tube having an opening in a side surface thereof, said opening lying at least 1½ inches above said attachment end;

a flexible plastic vent hose passing through said opening in said side surface and having a side pipe portion extending outside said body tube and an interior portion of a length selected to extend through a wall of said body tube into said container for venting the bottom of said container upon inversion of said container to thereby accelerate the discharge of fluid out of said container through said body tube and into the mouth of the user; and a seal located between the side surface of said body tube and said vent hose.

19. The device of claim 18 wherein said cylindrical tube comprises a polyvinyl chloride material of shore 85.

20. The device of claim 19 wherein said plastic tube comprises a polyvinyl chloride material of shore 72.

21. The device of claim 20 wherein the inside diameter of said plastic tube is 3/16 inch.

22. The device of claim 21 wherein the inside diameter of said cylindrical tube is one inch.

* * * * *